United States Patent [19]

Jury

[11] Patent Number: 4,458,949

[45] Date of Patent: Jul. 10, 1984

[54] MANHOLE CASTING REMOVING DEVICE

[76] Inventor: Robert Jury, 1465 N. Main St., Box 565, A&Marion, Ohio 43302

[21] Appl. No.: 301,716

[22] Filed: Sep. 14, 1981

[51] Int. Cl.[3] ..... E21C 47/00; E01C 23/00

[52] U.S. Cl. ..... 299/41; 299/90; 404/90

[58] Field of Search ..... 299/41, 39, 90; 404/90, 404/91; 408/77, 703, 204, 205, 206; 144/2 N

[56] References Cited

U.S. PATENT DOCUMENTS

| | | | |
|---|---|---|---|
| Re. 29,356 | 8/1977 | Bennett | 299/87 |
| 799,880 | 9/1905 | Tonge, Jr. | 175/403 |
| 1,812,771 | 6/1931 | Blood et al. | 299/90 |
| 2,319,528 | 5/1943 | Barbour et al. | 408/205 |
| 2,747,475 | 5/1956 | West | 404/91 |
| 2,830,795 | 4/1958 | Center, Jr. | 175/403 |
| 3,539,014 | 11/1970 | Jonsson | 299/41 |
| 3,767,262 | 10/1973 | Pentith | 299/39 |
| 3,825,361 | 7/1974 | Steiner | 404/90 |

*Primary Examiner*—William F. Pate, III
*Assistant Examiner*—Hoang C. Dang
*Attorney, Agent, or Firm*—John L. Gray

[57] ABSTRACT

A device for cutting through pavement in order to remove a manhole casting during the repaving of a road surface so that the manhole casting may be raised or lowered to correspond with the elevation of the new road surface. The device is mounted on a conventional road grader that has been modified to accommodate the device and is positioned over the manhole casting so that the existing pavement and cement may be cut from the road surface and the manhole casting removed to permit bricks to be laid on or removed from the manhole so as to raise or lower the manhole so that the manhole casting's height will correspond with the elevation of the new road surface.

5 Claims, 4 Drawing Figures

MANHOLE CASTING REMOVING DEVICE

SUMMARY OF THE INVENTION

This invention relates to a machine for use in cutting through a road surface so as to enable a manhole casting to be removed from the top of a manhole so that the manhole's height can be raised or lowered so that the manhole casting's height will correspond with the elevation of the surface of the new roadway.

In resurfacing asphalt roads, oftentimes additional asphalt is applied to the existing surface of the road so that the new road surface often is approximately two inches higher than the preexisting surface. If the road has been resurfaced several times, instead of merely applying additional asphalt to the existing surface of the road, the road surface is scraped and removed and than a fresh application of asphalt is made. In either case, in roadways that are fitted with manholes it is necessary to remove the manhole castings and, in some cases, to raise the manholes so that the manhole casting's height will correspond with the elevation of the surface of the roadway or, alternatively, to remove brick from the upper surface of the manhole so that when the manhole casting is replaced on the top of the manhole it will correspond with the new lower elevation of the surface of the roadway.

Sewer lines and telephone cable lines quite often will have access points known as "manholes." These oftentimes are located in streets and highways. The manhole itself is a structure that is usually made by laying up layers of brick into a circular structure complete with an interior ladder that permits access to the telephone lines or sewer for inspection, cleaning, etc. The top of the bricked portion has placed thereon a circular cover called a "manhole casting" which is a cast iron cylindrical unit provided with a flat base which rests on the upper surface of the bricked up manhole. It usually is approximately 400 pounds in weight, and usually has a lip which is covered with cement and macadam so as to prevent it from moving with respect to the manhole and the road surface. The manhole casting receives a manhole lid which is the only portion of the entire structure that is generally visible to the casual observer from the surface of the roadway.

When a road is resurfaced with asphalt, the elevation of the road is modified. If the road is merely resurfaced, the height of the road, especially in the center portion where the manhole is usually located, is increased by approximately one and a half to two inches. On the other hand, if it is necessary to scrape off the road surface because of having had previous resurfacing applications, the elevation of the road can actually be reduced. Therefore, it is necessary to raise or lower the level of the manhole casting to coincide with the change in the height in the surface of the roadway. In order to do this, it is necessary to remove the existing asphalt and/or concrete subbase surrounding the manhole casting so that the manhole casting may be lifted from the bricked-up manhole and courses of bricks added or removed at the top of the manhole, following which the manhole casting is then replaced on the top of the manhole and suitable cement and macadam is placed around the manhole casting on the manhole so that the top of the manhole casting will be at the same elevation as the surface of the road.

In order to do this, a team of two to three men, equipped with jackhammers and their associated air compressors, are required to break out the existing macadam and cement so that the manhole casting may be freed from the road surface and lifted up for rebricking. This normally takes two hours or the equivalent of four manhours. Furthermore, because these individuals usually are working on a roadway that has some traffice flowing through it, there are the additional safety requirements associated with protecting the individuals while they are working. This is a time-consuming and expensive operation in the resurfacing of roadways.

The contractors who are involved in such resurfacing operations usually have among their various pieces of equipment a conventional road grader.

The instant invention is directed to an attachment for a road grader which utilizes the support system of the road grader and the hydraulic cylinders and controls of the road grader so as to enable the manhole casting to be separated from the road bed quickly and safely by one individual operating a road grader so modified.

Utilizing the invention which is the subject matter of this patent application an operator can remove the road surface so as to free up the manhole cover in from five to 20 minutes, and in an average time of about ten minutes.

An object of this invention therefore is to provide a machine which can be used to remove the road surface material which holds a manhole casting on the top of a manhole so that the manhole casting may be removed for purposes of adjusting the level of the manhole casting to the level of the new road surface.

Another object of this invention is to provide such a device which may be used in conjunction with an existing road grader with a portion of the road grader's normal complement of tools removed.

A still further object of this invention is to provide such a machine which will accomplish the removal of the road surface material surrounding a manhole casting quickly and safely without causing any of the road surface material to fall down into the manhole.

These together with other objects and advantages of the invention will become apparent in the details of construction and operation as more fully described hereinafter and claimed, reference being had to the accompanying drawings forming a part hereof wherein like numerals refer to like parts throughout.

DETAILED DESCRIPTION OF THE INVENTION

Figure 1:
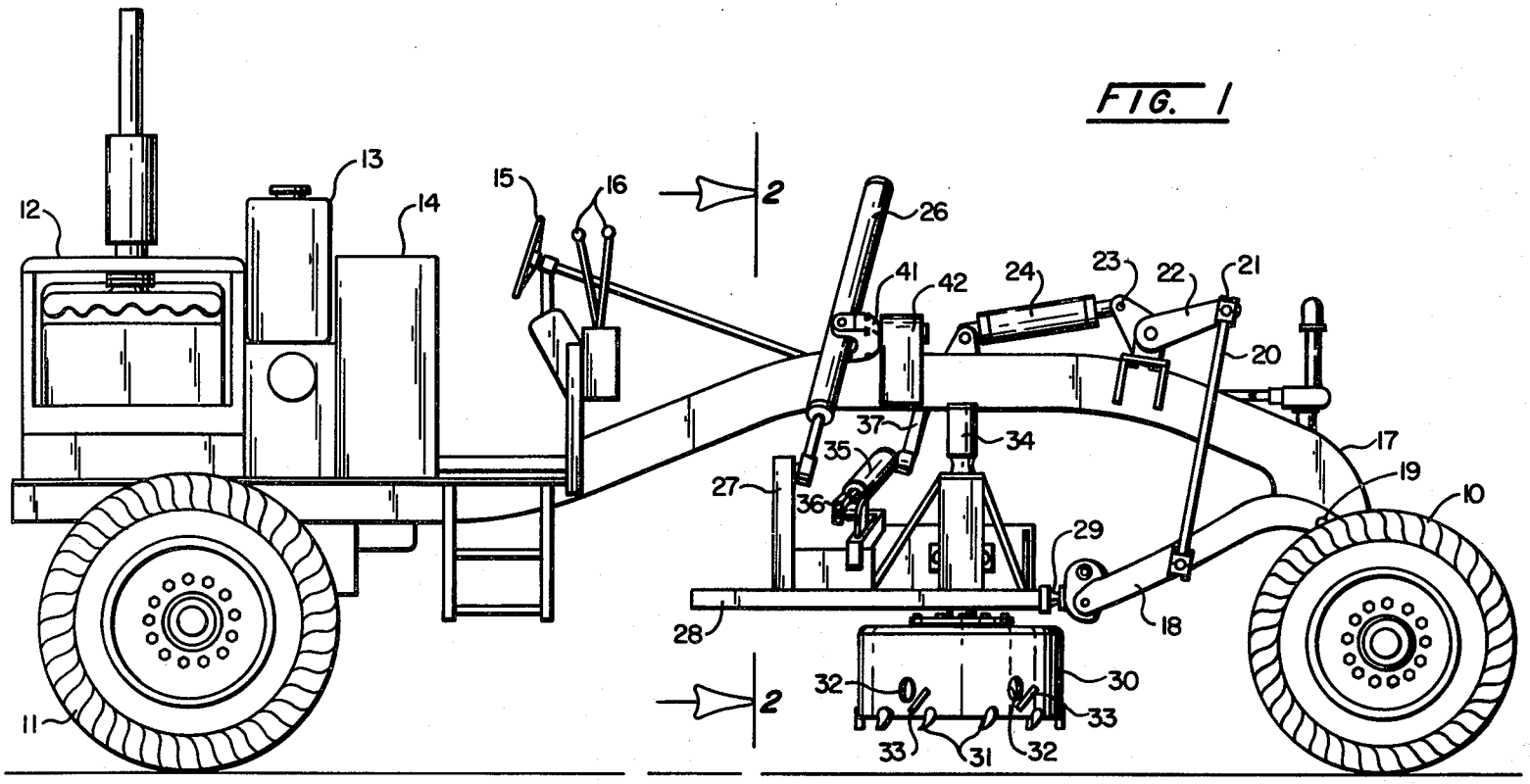
FIG. 1 is a side elevation view of applicant's manhole cover removing machine mounted on a conventional road grader.

Referring now more particularly to the drawings and to FIG. 1, applicant's invention is shown as a part of a conventional road grading machine. The road grading machine has forward wheels 10 and rear driven wheels 11, an appropriate engine 12, fuel and hydraulic supply tanks 13, operator's seat 14, steering gear 15, controls 16-16, and main frame 17. An additional support member 18 is pivoted on the main frame 17 at pivot point 19. Support member 18 may be raised or lowered by means of lever arm 20 which is pivoted at point 21 to bell crank 22 which in turn at pivot point 23 is connected to a hydraulic cylinder 24 which is connected to the main frame 17 at pivot point 25. Hydraulic cylinders 26-26 are connected to frame 27 which in turn is connected to the motor and cutting tool support platform 28 which also is connected to support member 18 at a universal joint 29. The cutting tool generally is shown at 30 and is provided with cutting teeth 31-31, holes 32-32 spaced at approximately 90 degree positions around the periphery of said cutting tool and each hole being provided with a slanted projection 33-33, the purpose of which will be described more fully later.

The hydraulic motor 34 is supported on the support plate 28 and directly connected to the cutting tool 30. Hydraulic cylinder 35 is also connected to the support plate assembly at pivot 36 and is also connected to the main frame 17 by arm 37.

Figure 2:
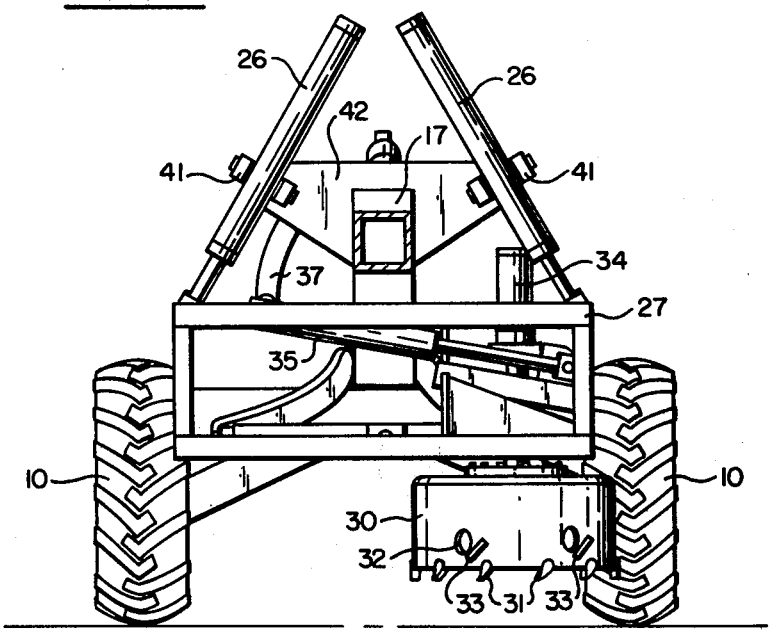
FIG. 2 is a section of FIG. 1 on the section line 2—2 of FIG. 1.

Referring now more particularly to FIG. 2, it will be seen that hydraulic cylinders 26-26 are used to tilt the cutting tool 30 and also to lower the rear portion thereof into engagement with the surface of the roadway. Hydraulic cylinder 35 is used to move the cutting tool transversely of the longitudinal direction of the machine to effect exact positioning of the cutting tool over the manhole casting to be removed. The forward portion of the cutting tool is lowered by activating cylinder 24 which in turn causes support member 18 pivoted at pivot point 19 to be lowered.

Figure 3:
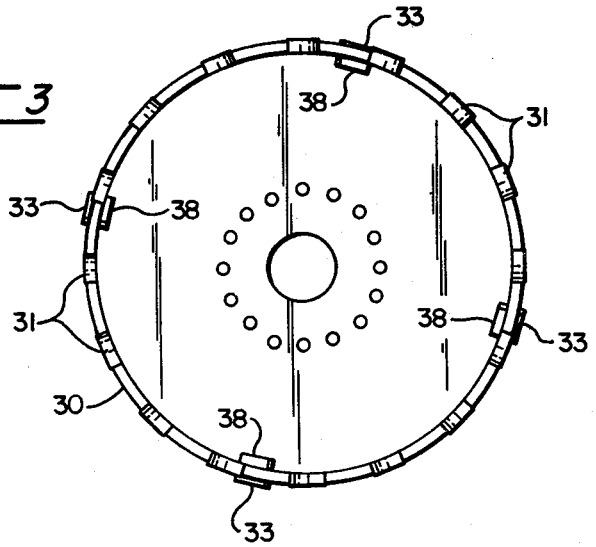
FIG. 3 is a view of the cutting head from underneath the machine.

Referring now more particularly to FIG. 3, it will be seen that cutting tool 30 which is provided with cutting teeth 31-31 thereon is provided with slanted projections 33-33 on the exterior thereof adjacent to the holes 32-32 and also provided with corresponding slanted projections 38-38 on the interior of cutting tool 30 adjacent to said holes.

Figure 4:
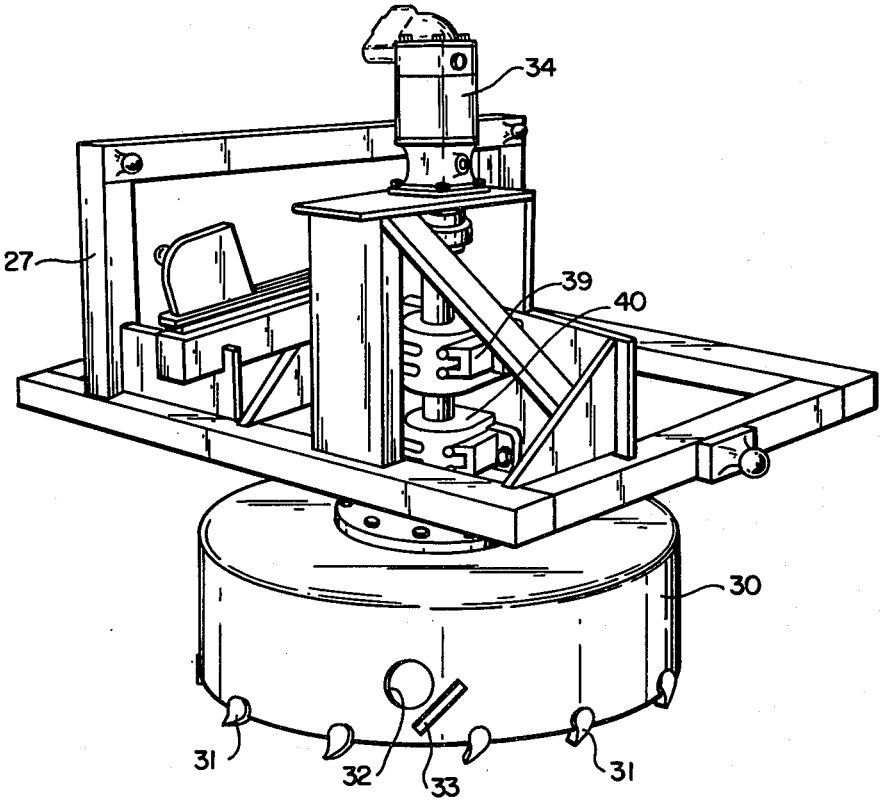
FIG. 4 is a perspective view of the cutting head and associated hydraulic drive motor and assorted structural supports which may be added to a conventional road grader.

Referring now more particularly to FIG. 4, the cutting tool 30 is shown as provided with cutting teeth 31-31, holes 32-32, slanted projections 33-33, support plate 28, frame 27 and drive motor 34, appropriate thrust bearings 39-39 and 40-40 are also shown.

Hydraulic cylinders 26-26 are pivotally mounted on frame 17 by means of yokes 41-41 and support 42 attached to frame 17. Thus, grading mold board, the scarifier, and associated connections are removed from a conventional road grader, and these are replaced with the assemblage consisting of the cutting tool 30, the motor 34, support plate 28, and assorted portions which are connected to the appropriate support members and hydraulic cylinders.

The hydraulic lines to control these cylinders are not shown for purposes of clarity but are rather obvious and well within the understanding of a person skilled in this art.

In operation, therefore, the modified road grader is moved so that the cutting tool 30 is approximately positioned over the manhole casting to be removed. The exact positioning of the cutting tool 30 over the manhole casting is accomplished by lateral movement of the support plate 28 by means of the hydraulic cylinder 35. Also, further adjustments may be accomplished by movement of the cylinders 26-26 and the cylinder 24, although these cylinders are primarily used to lower the entire support platform and the cutting tool 30 so that it may be used to remove the asphaltic surface materials surrounding and engaging the manhole cover. The motor driving the cutting tool is hydraulically operated from the same hydraulic pump system utilized to operate the other hydraulic controls on the road grader and as the platform 28 is lowered with the cutting device 30 rotating, the debris associated therewith is continuously removed and expelled exteriorly of the cutting head 30 because of the slanted members 33-33 exteriorly positioned adjacent to holes 32-32 of the cutting head 30 and the complementary slanted members 38-38 positioned on the interior surface of the cutting tool 30. The function of these slanted members is extremely important so that debris does not go down into the interior of the manhole but is kept on the surface of the pavement so that it may be readily removed. The machine may also be equipped with a lifting device which involves a plurality of hooks which may be inserted below the manhole casting so that when the platform 28 is raised the manhole casting may also be raised and removed from the location so that layers of brick may be laid on top of the manhole or removed therefrom. Such a chain and hook arrangement may be readily attached to the platform 28 although these are not shown in the drawings.

Benefits of this device are illustrated by the reference to the following example:

EXAMPLE

In July, 1981, on Bennett Street in Marion, Ohio, it was necessary during the resurfacing of that street to reposition 17 manhole castings; 11 of them were removed utilizing the invention, which is the subject matter of this patent application, and all 11 of these were removed in three hours. The actual removal time varied from five minutes to 20 minutes.

While this invention has been described in its preferred embodiment, it is appreciated that variations thereon may be made without departing from the proper scope and spirit of the invention.

What is claimed is:

1. A manhole casting removing device comprising a main frame, motor means on said main frame, wheels supporting one end of said main frame driven by said motor means, steerable wheels supporting the other end of said main frame, a hydraulic motor supported by said main frame, a hollow cylindrical cutting tool, having a constant diameter throughout its entire cylindrical length slightly larger than the manhole casting to be removed and having its axis in a vertical position, attached to and driven by said hydraulic motor, said hydraulic motor being positioned exteriorly of said cutting tool, said cylindrical cutting tool being provided with a plurality of cutting teeth means, said cutting teeth means for cutting a narrow cylindrical ring around said manhole casting, said cutting teeth means being on the lower peripheral edge of said cylindrical cutting tool, means for raising and lowering said cutting tool, and means for moving said cutting tool laterally of said main frame.

2. The device of claim 1 wherein said means for raising and lowering said cutting tool and means for moving said cutting tool laterally of said main frame comprises hydraulic cylinders.

3. The device of claim 1 wherein said cylindrical cutting tool is provided with a plurality of spaced openings in said cylindrical portion of said cutting tool adjacent said cutting teeth.

4. The device of claim 3 wherein slanted projections extending at right angles to the surface of said cylindrical cutting tool are positioned adjacent said openings on either side of the surface of said cylindrical portion of said cylindrical cutting tool.

5. The device of claim 4 wherein said slanted projections are placed at approximately a 45° angle to the axis of the cylindrical portion of said cylindrical cutting tool.

* * * * *